US010688811B2

(12) United States Patent
Nishimura et al.

(10) Patent No.: US 10,688,811 B2
(45) Date of Patent: Jun. 23, 2020

(54) AIR BLOWER, DRYING DEVICE, LIQUID DISCHARGE APPARATUS, AND TREATMENT-LIQUID APPLICATION DEVICE

(71) Applicants: Hideaki Nishimura, Kanagawa (JP); Toshihiro Yoshinuma, Kanagawa (JP)

(72) Inventors: Hideaki Nishimura, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/264,298

(22) Filed: Jan. 31, 2019

(65) Prior Publication Data

US 2019/0263143 A1 Aug. 29, 2019

(30) Foreign Application Priority Data

Feb. 27, 2018 (JP) ..... 2018-032948
Nov. 30, 2018 (JP) ..... 2018-224512

(51) Int. Cl.
*B41J 11/00* (2006.01)
*F24H 3/02* (2006.01)

(52) U.S. Cl.
CPC ..... *B41J 11/002* (2013.01); *F24H 3/02* (2013.01)

(58) Field of Classification Search
CPC ..... B41F 15/20; B41J 11/02; B41J 11/007; B41J 13/054; B41J 13/103; B41J 13/12; B41J 13/226; B41J 13/24; B41J 15/005; B41J 15/048; B41J 17/02; B41J 2/114; B41J 11/00; B41J 11/0015; F24H 3/02
See application file for complete search history.

(56) References Cited

U.S. PATENT DOCUMENTS 9,776,439 B2 * 10/2017 Sanaei ..... B41J 2/155
9,835,991 B2 * 12/2017 Ishii ..... G03G 15/205
2013/0021412 A1 1/2013 Nishimura et al.
2013/0070021 A1 3/2013 Nishimura et al.
2013/0215188 A1 8/2013 Nishimura et al.
2014/0028756 A1 1/2014 Nishimura et al.
(Continued)

FOREIGN PATENT DOCUMENTS

JP 2004-361015 12/2004
JP 2006-175802 7/2006
(Continued)

OTHER PUBLICATIONS

U.S. Appl. No. 16/040,007, filed Jul. 19, 2018, Hideaki Nishimura, et al.

*Primary Examiner* — Kristal Feggins
(74) *Attorney, Agent, or Firm* — Duft & Bornsen, PC

(57) ABSTRACT

A gas blower includes a supply port, a chamber to which a gas is fed from the supply port, a nozzle communicating with an interior of the chamber to discharge the gas from the nozzle, a partition member disposed in the chamber to partition the interior of the chamber into a first space including the supply port and a second space not including the supply port, the partition member including at least one first opening through which the gas communicates between the first space and the second space, and an air flow guide including a plurality of second openings, disposed in the chamber between the second space and the nozzle. The supply port is disposed on one end in a longitudinal direction of the chamber.

12 Claims, 10 Drawing Sheets

(56) References Cited

U.S. PATENT DOCUMENTS

| | | | |
|---|---|---|---|
| 2014/0210919 | A1 | 7/2014 | Walker et al. |
| 2016/0101635 | A1 | 4/2016 | Hoshino et al. |
| 2016/0190329 | A1 | 6/2016 | Matsumoto et al. |
| 2016/0243835 | A1 * | 8/2016 | Shinbara ..... B41J 2/16552 |
| 2016/0267873 | A1 | 9/2016 | Saotome et al. |
| 2017/0121543 | A1 | 5/2017 | Sakaguchi et al. |
| 2017/0130081 | A1 | 5/2017 | Toyama et al. |
| 2017/0173974 | A1 | 6/2017 | Hoshino et al. |
| 2017/0266991 | A1 | 9/2017 | Onodera et al. |
| 2017/0361632 | A1 | 12/2017 | Toyama et al. |
| 2018/0141348 | A1 | 5/2018 | Hoshino et al. |
| 2018/0244935 | A1 | 8/2018 | Sakaguchi et al. |

FOREIGN PATENT DOCUMENTS

| | | |
|---|---|---|
| JP | 2008-246415 | 10/2008 |
| JP | 2014-148168 | 8/2014 |
| JP | 2015-046568 | 3/2015 |
| JP | 2015-111653 | 6/2015 |
| JP | 2016-029716 | 3/2016 |

* cited by examiner

AIR BLOWER, DRYING DEVICE, LIQUID DISCHARGE APPARATUS, AND TREATMENT-LIQUID APPLICATION DEVICE

CROSS-REFERENCE TO RELATED APPLICATIONS

This patent application is based on and claims priority pursuant to 35 U.S.C. § 119(a) to Japanese Patent Application No. 2018-032948, filed on Feb. 27, 2018, and Japanese Patent Application No. 2018-224512, filed on Nov. 30, 2018, in the Japan Patent Office, the entire disclosure of each of which is hereby incorporated by reference herein.

BACKGROUND

Technical Field

The present disclosure relates to an air blower, a drying device, a liquid discharge apparatus, and a treatment-liquid application device.

Related Art

A printing apparatus is known that applies liquid onto an object to be heated such as a rolled sheet, continuous sheet, web, or the like to perform printing, and which includes a drying device to accelerate drying of the applied liquid on the object to be heated.

Similarly, a drying device is known that includes elongated heaters elongated in a direction perpendicular to a direction of movement of the object to be heated and blowers including an elongated nozzle extending in a direction perpendicular to the direction of movement of the object to be heated. The heaters and the blowers are alternately arranged along the direction of movement of the object to be heated. The air warmed by the heaters is blown onto the object to be heated from the nozzles of the blowers.

SUMMARY

In an aspect of this disclosure, a novel gas blower is provided in which the gas blower includes a supply port, a chamber to which a gas is fed from the supply port, a nozzle communicating with an interior of the chamber to discharge the gas from the nozzle, a partition member disposed in the chamber to partition the interior of the chamber into a first space including the supply port and a second space not including the supply port, the partition member including at least one first opening through which the gas communicates between the first space and the second space, and an air flow guide including a plurality of second openings, disposed in the chamber between the second space and the nozzle. The supply port is disposed on one end in a longitudinal direction of the chamber. An opening ratio of the first opening of the partition member at a central portion in a longitudinal direction of the partition member is larger than an opening ratio of the first opening of the partition member at both end portions in the longitudinal direction of the partition member.

In another aspect of this disclosure, a novel gas blower is provided in which the gas blower includes a supply sport, a chamber to which a gas is fed from the supply port, a nozzle communicating with an interior of the chamber to discharge the gas from the nozzle, a partition member disposed in the chamber to partition the interior of the chamber into a first space including the supply port and a second space not including the supply port, the partition member including at least one first opening through which the gas communicates between the first space and the second space, and an air flow guide including a plurality of second openings, disposed in the chamber between the second space and the nozzle. The supply port is disposed on a central portion in a longitudinal direction of the chamber. An opening ratio of the first opening of the partition member at a central portion in a longitudinal direction of the partition member is smaller than an opening ratio of the first opening of the partition member at both end portions in the longitudinal direction of the partition member.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
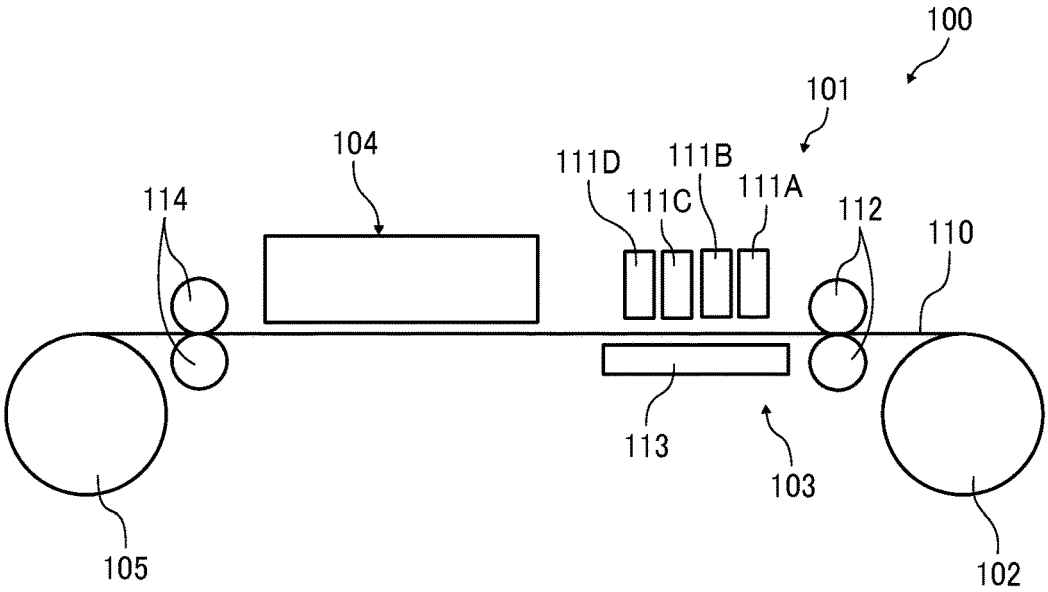
FIG. 1 is a schematic side view of a printer as a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, exemplary embodiments of the present disclosure are described below.

A first embodiment of the present disclosure is described with reference to FIG. 1. FIG. 1 is a schematic side view of an example of a printing apparatus as a liquid discharge apparatus according to the present embodiment.

The printing apparatus 100 is an inkjet recording apparatus. The printing apparatus 100 includes a liquid application unit 101 including a liquid discharge head 111 (111A to 111D) which is a liquid applicator to discharge and apply ink, which is a liquid of a desired color, onto a continuous sheet 110, which is a medium (or member) to be conveyed. The medium to be conveyed is also a medium to be heated or dried. Hereinafter, the "liquid discharge head" is also simply referred to as a "head".

In the liquid application unit 101, for example, full-line heads 111A, 111B, 111C, and 111D (referred to as "heads 111" unless colors distinguished) of four colors are disposed in this order from the upstream side in a conveyance direction of the continuous sheet 110. The heads 111 apply liquids of black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 is fed from a feeding roller 102, is sent onto a conveyance guide 113 by conveyance rollers 112 of a conveyance unit 103, and is guided and conveyed (moved) to a position opposite the liquid application unit 101 by the conveyance guide 113. The conveyance guide 113 is disposed to face the liquid application unit 101.

The continuous sheet 110, onto which the liquid is applied by the liquid application unit 101, passes a drying device 104 serving as a drying device according to the present embodiment and is sent by ejection rollers 114 and wound around a winding roller 105.

Figure 2:
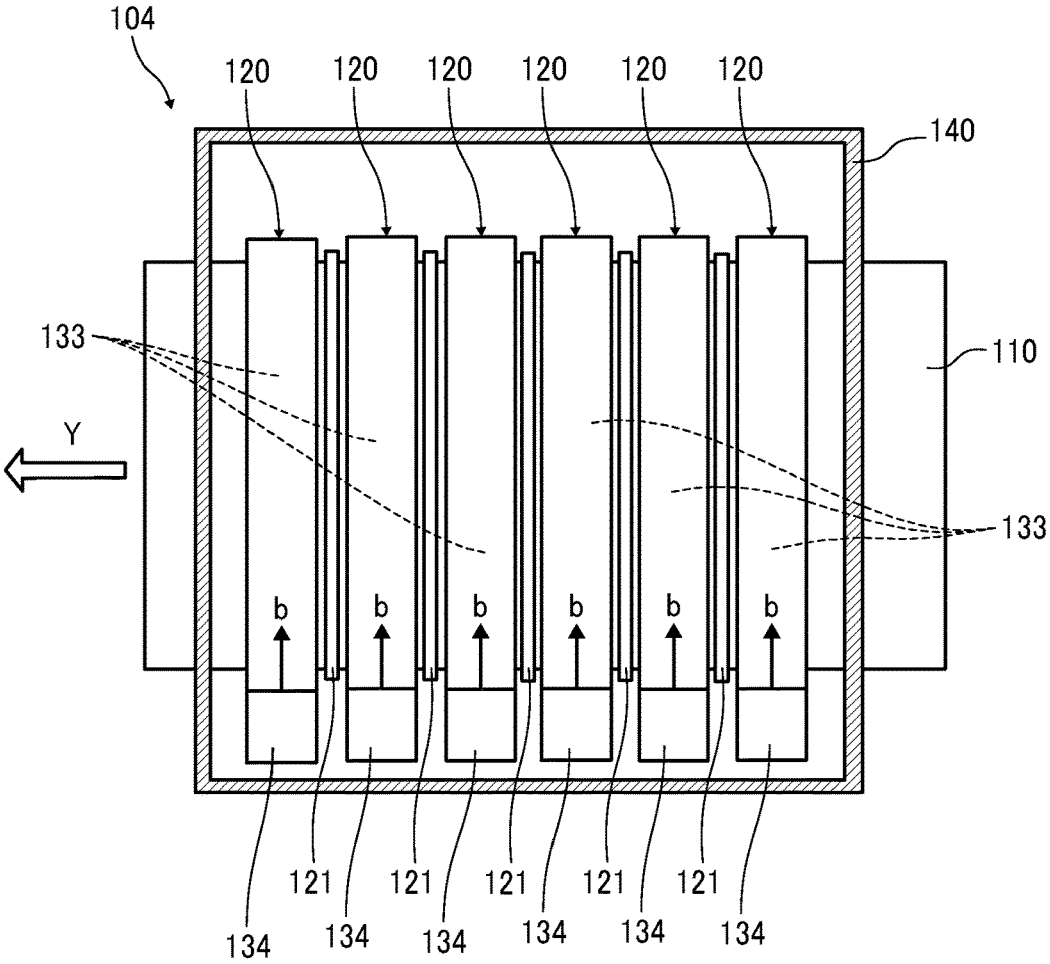
FIG. 2 is a plan view of a drying device according to a first embodiment of the present disclosure.
Figure 3:
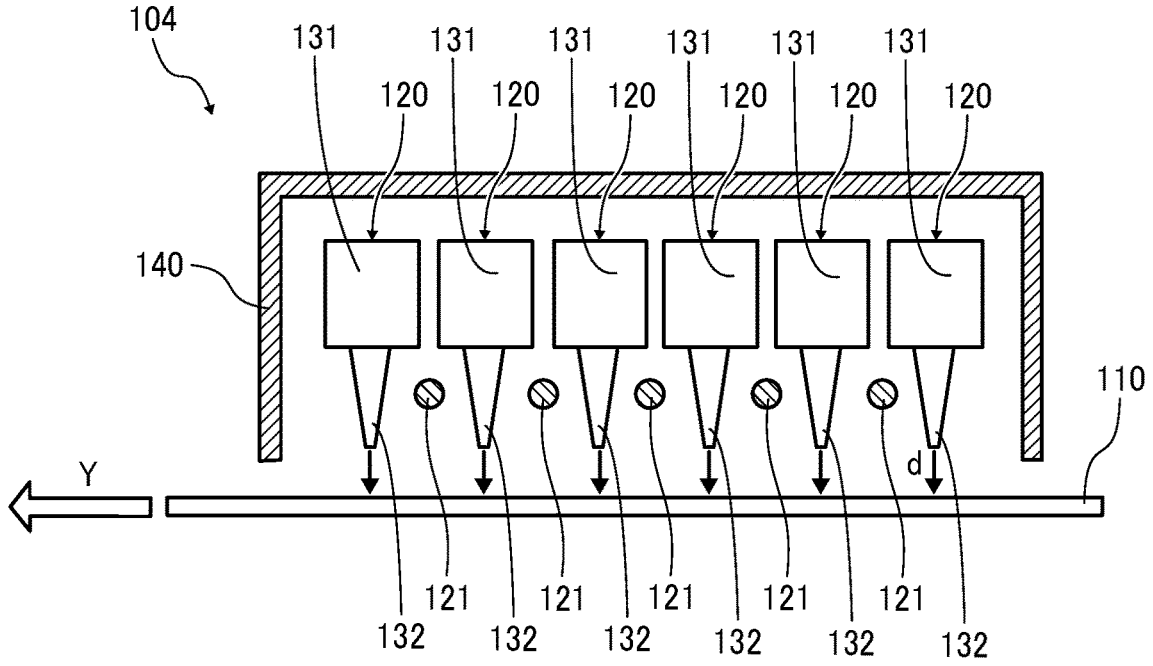
FIG. 3 is a side view of the drying device according to the first embodiment.

Next, the drying device according to a first embodiment is described with reference to FIGS. 2 and 3. FIG. 2 is a schematic plan view of the drying device, and FIG. 3 is a schematic side view of the drying device.

The drying device 104 includes a plurality of air knives 120 disposed along a direction of movement of the continuous sheet 110 to be dried. The direction of movement of the continuous sheet 110 is indicated by arrow Y in FIG. 2 and is also referred to as the "conveyance direction Y". The drying device 104 includes six air knives 120 in FIG. 2. The plurality of air knives 120 is a gas blower to blow air according to the present embodiment.

Further, the drying device 104 includes a plurality of radiation heaters 121 disposed outside the air knives 120 but between the adjacent air knives 120. The plurality of radiation heaters 121 heats air inside the air knives 120.

Each of the air knives 120 includes an elongated chamber 131 and a nozzle 132 serving as a discharge port communicating with the interior 133 of the chamber 131. Details of the air knives 120 are described below. The nozzle 132 has a length corresponding to a width of the continuous sheet 110 in a direction intersecting (perpendicular, for example) the conveyance direction Y.

Further, each of the air knives 120 of the present embodiment includes a fan 134 at one end in a longitudinal direction of the chamber 131. The fan 134 serves as an air flow generator to feed a gas (in this case air) into an interior 133 of the chamber 131. As the fan 134 serving as the airflow generator, for example, a counter-rotating fan or the like is used to obtain a large airflow.

Here, the air knife 120 is an air blower in which a fan 134 is disposed on one end side of the air knife 120 in a direction intersecting the direction of movement (conveyance direction Y) of the continuous sheet 110. The fan 134 serves as an air generator. Airflows are generated in a direction indicated by arrow "b" (see FIG. 2) in the interior 133 of the chamber 131 by the fan 134 of the air knife 120. Thus, gas (air) is discharged (blown out) in a direction indicated by arrow "d" from the nozzle 132 as illustrated in FIG. 3.

The radiation heater 121 is arranged between the adjacent air knives 120 in the conveyance direction Y. That is, the air knives 120 and the radiation heaters 121 are alternately arranged in the drying device 104 as illustrated in FIG. 2.

Thus, one radiation heater 121 can heat the air inside two adjacent air knives 120. However, the radiation heater 121 may be disposed between each of the two airs knives 120, for example.

The radiation heater 121 is preferably an infrared heater that irradiates infrared rays having a maximum wavelength in an absorption wavelength band of moisture contained in the liquid. Further, it is preferable to use a carbon heater using carbon as the material of the heating element.

The air knives 120 and the radiation heaters 121 are surrounded by a device exterior 140.

Next, an operation of the drying device 104 is described below.

The continuous sheet 110 to which the liquid is applied by the liquid application unit 101 is conveyed in the conveyance direction Y and passes through the drying device 104.

The drying device 104 supplies electric power to the radiation heaters 121 and directly applies radiation heat to the conveyed continuous sheet 110 from the radiation heater 121. Thus, the continuous sheet 110 is heated by radiant heat radiated from the radiation heater 121.

Further, the air inside the chamber 131 of the air knife 120 is heated by the radiation heat from the radiation heater 121. Then, the drying device 104 drives the fan 134 to send the gas to the interior 133 of the chamber 131. Thus, gas (warm air) is discharged (blown out) in a direction indicated by arrow "d" from the nozzle 132 and is blown onto the conveyed continuous sheet 110.

As a result, the liquid on the continuous sheet 110 is heated to raise a vapor pressure of the liquid. Thus, the drying device 104 can dry the continuous sheet 110.

When the drying device 104 dries the continuous sheet 110, the gas blown out from the air knife 120 generates colliding jet collided at the continuous sheet 110 that prevents excessive heating of the continuous sheet 110 by the radiation heat radiated from the radiation heater 121 since the radiation heaters 121 and the air knives 120 are alternately arranged in the drying device 104.

Figure 4:
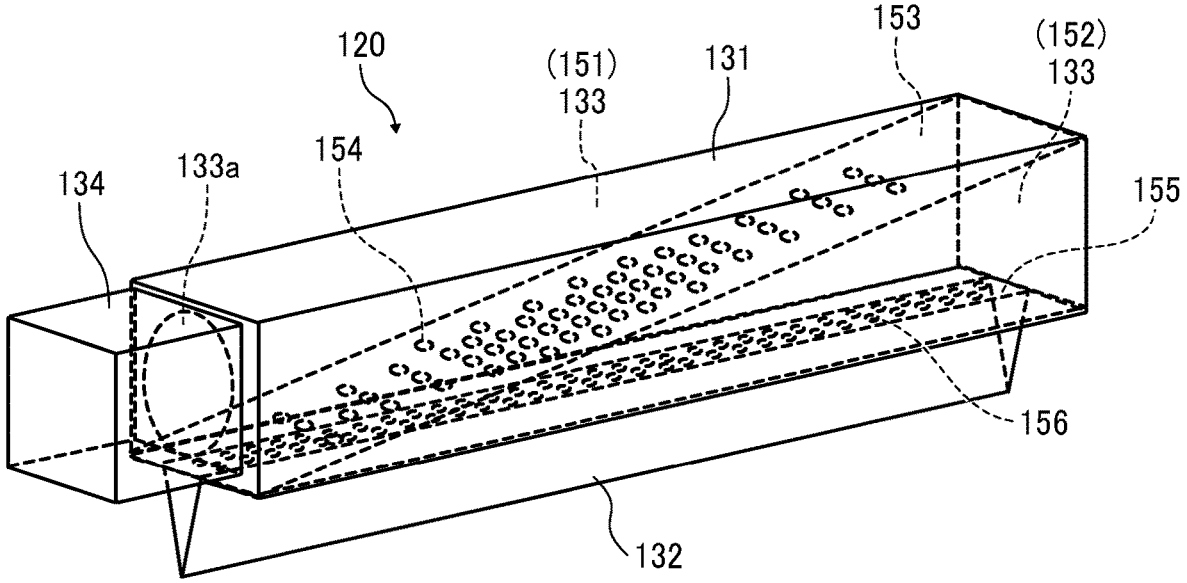
FIG. 4 is a perspective view of a gas blower in the drying device according to the first embodiment.
Figure 5:
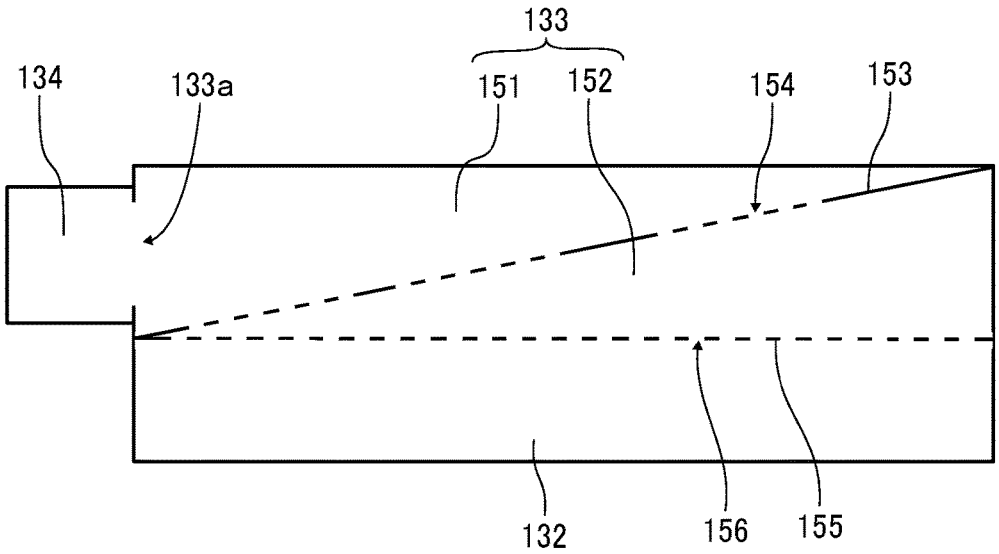
FIG. 5 is a front view of the gas blower in the drying device according to the first embodiment.

Next, the gas blower according to the first embodiment is described with reference to FIGS. 4 to 6. FIG. 4 is a perspective view of the gas blower of the first embodiment. FIG. 5 is a front view of the gas blower of the first embodiment. FIGS. 6A to 6C are plan views of a partition, an air flow guide, and nozzles in the first embodiment, respectively.

The air knife 120 serving as a gas blower includes a chamber 131 and a nozzle 132. The chamber 131 has an interior 133 into which the gas from the fan 134 is fed via a supply port 133*a*. The nozzle 132 is a slit-shaped discharge port communicating with the interior 133 of the chamber 131. Note that the nozzle 132 may also be arranged such that a plurality of discharge ports is arranged in a row.

The air knife 120 includes a plate-shaped partition member 153 that partitions the interior 133 into a first space 151 including the supply port 133*a* and a second space 152 not including the supply port 133*a* in the chamber 131.

The partition member 153 is inclined upward from the supply port 133*a* side to another end side (right end side in FIG. 4) that is the one end side opposite the supply port 133*a* in the longitudinal direction of the chamber 131. The inclined partition member 153 enables increasing a size of the supply port 133*a* while minimizing the height of the chamber 131.

The partition member 153 includes a plurality of openings 154 (first openings). The air in the chamber 131 can pass through the plurality of openings 154 of the partition member 153 between the first space 151 and the second space 152. As illustrated in FIG. 6A, the openings 154 of the partition member 153 is formed such that an opening ratio at a central portion A in the longitudinal direction of the partition member 153 is larger than an opening ratio at both end portions B and C in the longitudinal direction of the partition member 153. Note that the opening ratio is a ratio of the area of the openings 154 per unit area in the partition member 153. In FIGS. 6A to 6C, the sizes (areas) of all the openings 154 are the same, and a number of the openings 154 in each portions A to C is different. However, the sizes (areas) of all the openings 154 are not necessary the same.

Further, the air knife 120 includes a plate-shaped air flow guide 155 arranged between the second space 152 and the nozzle 132 in the chamber 131.

The air flow guide 155 includes a plurality of openings 156 (second openings) through which the air can communicate between the second space 152 and the nozzle 132. As illustrated in FIG. 6B, the openings 156 of the air flow guide 155 are arranged so that an opening ratio of the openings 156 is substantially uniform in the longitudinal direction of the air flow guide 155. The sizes (diameters) of each of the openings 156 are not necessarily the same.

The operation of the air knife 120 configured as described above is described below.

Figure 6A:
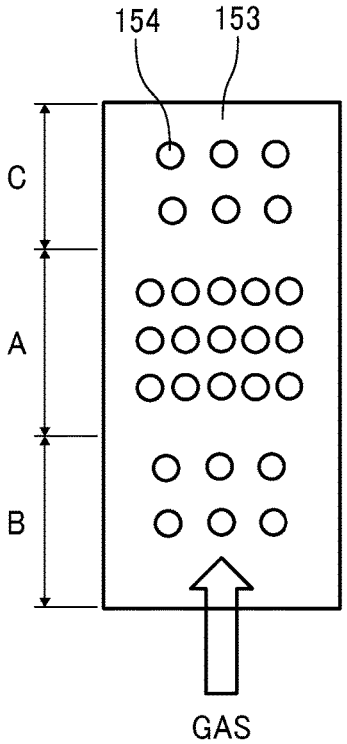
FIGS. 6A to 6C are plan views of a partition member, an air flow guide, and a nozzle, respectively.

As illustrated in FIG. 6A, gas (airflow) is generated by the fan 134 and is fed from the supply port 133*a* into the first space 151 in the interior 133 of the chamber 131. The gas (airflow) sent into the first space 151 passes through each of the openings 154 the partition member 153 and flows into the second space 152.

An opening ratio of the openings 154 in the central portion A of the partition member 153 is larger than an opening ratio of the openings 154 in the both end portions B and C of the partition member 153. For example, in the present embodiment, the number of openings 154 in the central portion A is fifteen, and the number of openings 154 in each of the both end portions B and C is six in which the size (area) of each of the openings 154 is the same. Thus, a flow rate PM of the gas flowing into the second space 152 from the first space 151 through each of the openings 154 in the central portion A of the partition member 153 is larger than flow rates Pb2 and Pb3 of the gas flowing into the second space 152 from the first space 151 through each of the openings 154 at both end portions B and C of the partition member 153.

Figure 6B:
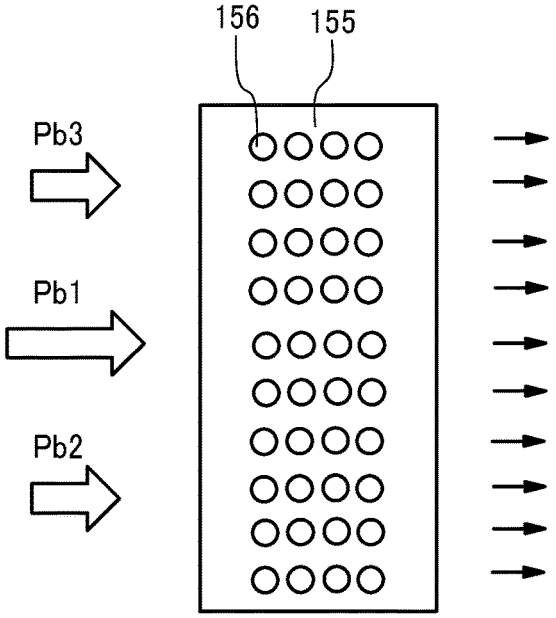
Figure 6C:
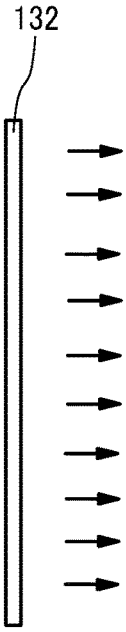

Then, the gas flowing into the second space 152 is dispersed by passing through each of the openings 156 of the air flow guide 155 having a substantially uniform opening ratio in the longitudinal direction of the air flow guide 155 as illustrated in FIG. 6B. The gas flows into the slit-shaped nozzle 132 illustrated in FIG. 6C from the second space 152 and is discharged (blown out) from the nozzle 132.

Thus, the air knife 120 of the present embodiment can reduce unevenness (variation) in the flow rate of the gas blown out from the nozzle 132 in the longitudinal direction of the air knife 120.

Further, because the partition member 153 has a relatively large opening ratio in the central portion A as illustrated in FIG. 6A, a length of the flow path from the fan 134 to the nozzle 132 becomes longer on a side (one end side) where the fan 134 is arranged in the interior 133 when the partition member 153 is provided in the chamber 131 because a large amount of the gas generated by the fan 134 has to pass through the openings 154 in the central portion A of the partition member 153 before flowing into the nozzle 132.

Thus, time to heat the gas in the chamber 131 by the radiant heat from the radiation heater 121 in the longitudinal direction of the chamber 131 is made uniform. Thus, the air knife 120 can reduce temperature unevenness (variation) of the gas blown out from the nozzle 132 in the longitudinal direction of the chamber 131.

If the air knife 120 does not include the partition member 153, time to heat the gas in the chamber 131 by the radiant heat from the radiation heater 121 increases as a distance from the fan 134 arranged at one end of the chamber 131 increases since the chamber 131 of the air knife 120 has an elongated interior 133. Thus, the temperature of the gas in the other end of the chamber 131 opposite the fan 134 becomes higher than the temperature of the gas in the one end of the chamber 131 by the fan 134 because the time to heat the gas in the chamber 131 is longer in the other end of the chamber 131 than the time for heating the gas in the one end of the chamber 131 where the fan 134 is arranged.

Therefore, the temperature of the gas blown out from the nozzle 132 is relatively low on one side (fan 134 side) and is relatively high on another side opposite the fan 134 side. Thus, uneven heating (uneven drying) occurs in the longitudinal direction of the chamber 131 (the direction across (perpendicular to) the conveyance direction of the continuous sheet 110).

Therefore, the partition member 153 of the air knife 120 of the present embodiment reduces a difference in a length of the flow path from the fan 134 to the nozzle 132 in the longitudinal direction of the chamber 131 and thus reduces a difference in time to heat the gas in the chamber 131 by radiant heat from the radiation heater 121 in the longitudinal direction of the chamber 131. Thus, the air knife 120 can reduce the temperature unevenness and the drying unevenness.

As a result, the air knife 120 can reduce overall heating unevenness (drying unevenness) in a width direction of the conveyed continuous sheet 110 that is a direction orthogonal to the conveyance direction Y. Thus, the air knife 120 can prevent excessive heating on one side of the conveyed continuous sheet 110 in the width direction of the conveyed continuous sheet 110 with relatively hot air blown onto the continuous sheet 110. Thus, the air knife 120 can prevent damage such as yellowing on an object to be dried (continuous sheet 110).

Further, the air flow guide 155 of the air knife 120 can even out a velocity distribution of air flow in the longitudinal direction of the chamber 131. Thus, the air knife 120 can reduce overall heating unevenness (drying unevenness) in the width direction of the conveyed continuous sheet 110.

Figure 7:
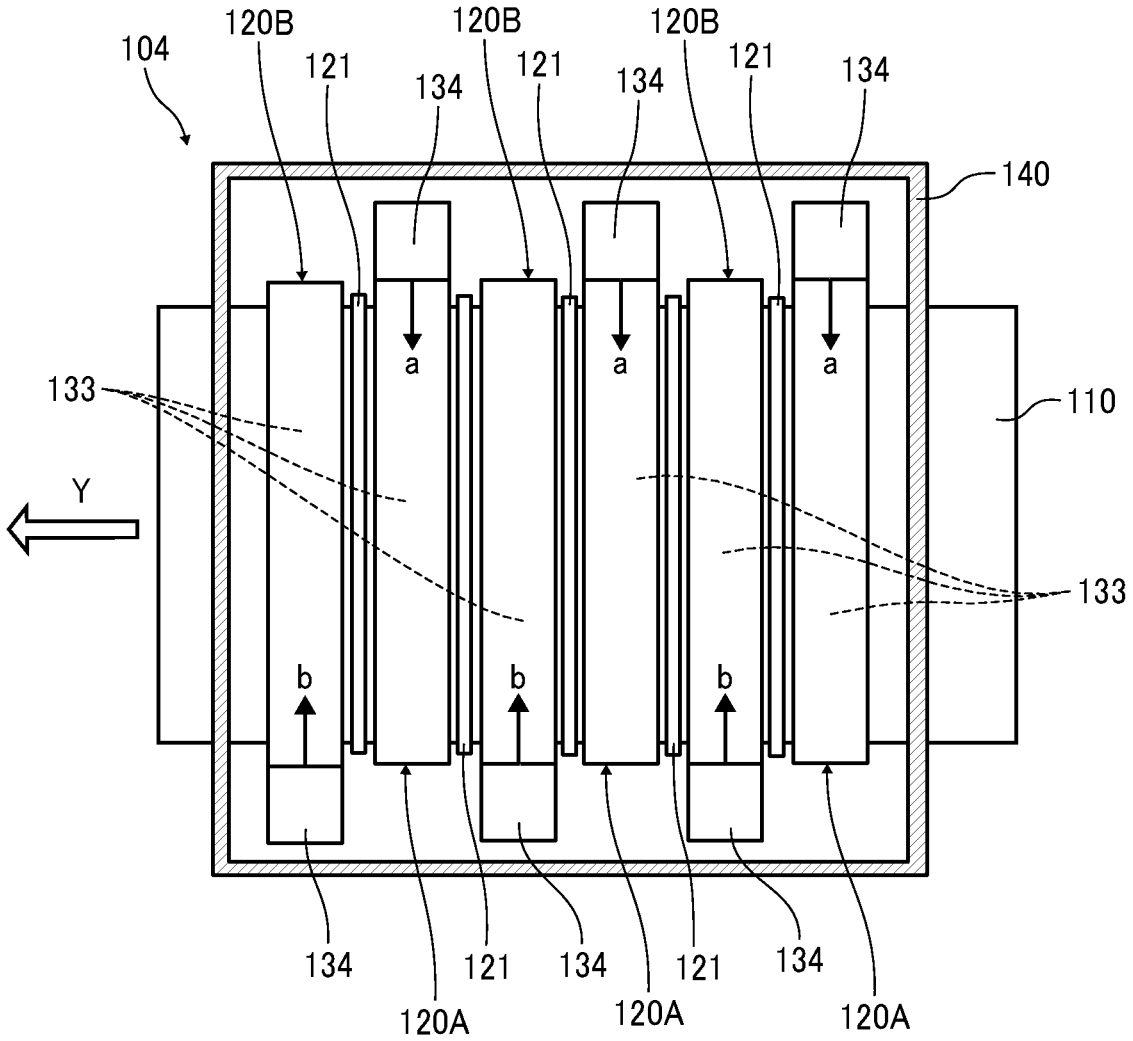
FIG. 7 is a plan view of a drying device according to a second embodiment of the present disclosure.

Next, a second embodiment of the present disclosure is described with reference to FIG. 7. FIG. 7 is a schematic plan view of the drying device 104 according to the second embodiment.

Also in the second embodiment, the drying device 104 includes air knives 120A and 120B serving as gas blowers to blow air according to the present embodiment. A plurality (six in FIG. 7) of the air knives 120A and 120B are arranged along the direction of movement (conveyance direction Y) of the continuous sheet 110 to be dried.

Radiation heaters 121 to heat the air inside the air knives 120A and 120B are disposed outside the air knives 120A and 120B but between the adjacent air knives 120A and 120B.

The air knives 120A are first blowers in each of which a fan 134 serving as an airflow generator is disposed on one end side in a direction intersecting (perpendicular to) the direction of movement (conveyance direction Y) of the continuous sheet 110. The fan 134 of the air knife 120A generates the airflow in a direction indicated by arrow "a" inside the chamber 131, and the gas is discharged (blown out) from the nozzle 132.

The air knives 120B are second air blowers in each of which the fan 134 serving as the airflow generator is disposed on another end side in the direction intersecting the direction of movement (conveyance direction Y) of the continuous sheet 110. The fan 134 of the air knife 120B generates the airflow in a direction indicated by arrow "b" inside the chamber 131, and the gas is discharged (blown out) from the nozzle 132.

The air knives 120A as the first air blowers and the air knives 120B as the second air blowers are arranged alternately along the direction of movement (conveyance direction Y) of the continuous sheet 110. In FIG. 7, the air knives 120A and 120B are arranged alternately every other air knives 120A and 120B. However, the air knives 120A and 120B may be arranged alternately every plural air knives 120A and 120B.

Thus, the air knives 120A and 120B enable uniform heating of the continuous sheet 110 in the direction of movement (conveyance direction Y) of the continuous sheet 110 so that heating unevenness remaining in each of air knives 120A and 120B along the direction of movement (conveyance direction Y) of the continuous sheet 110 can be reduced. Thus, it is possible to further reduce the overall heating unevenness (drying unevenness) to heat the continuous sheet 110.

Figure 8:
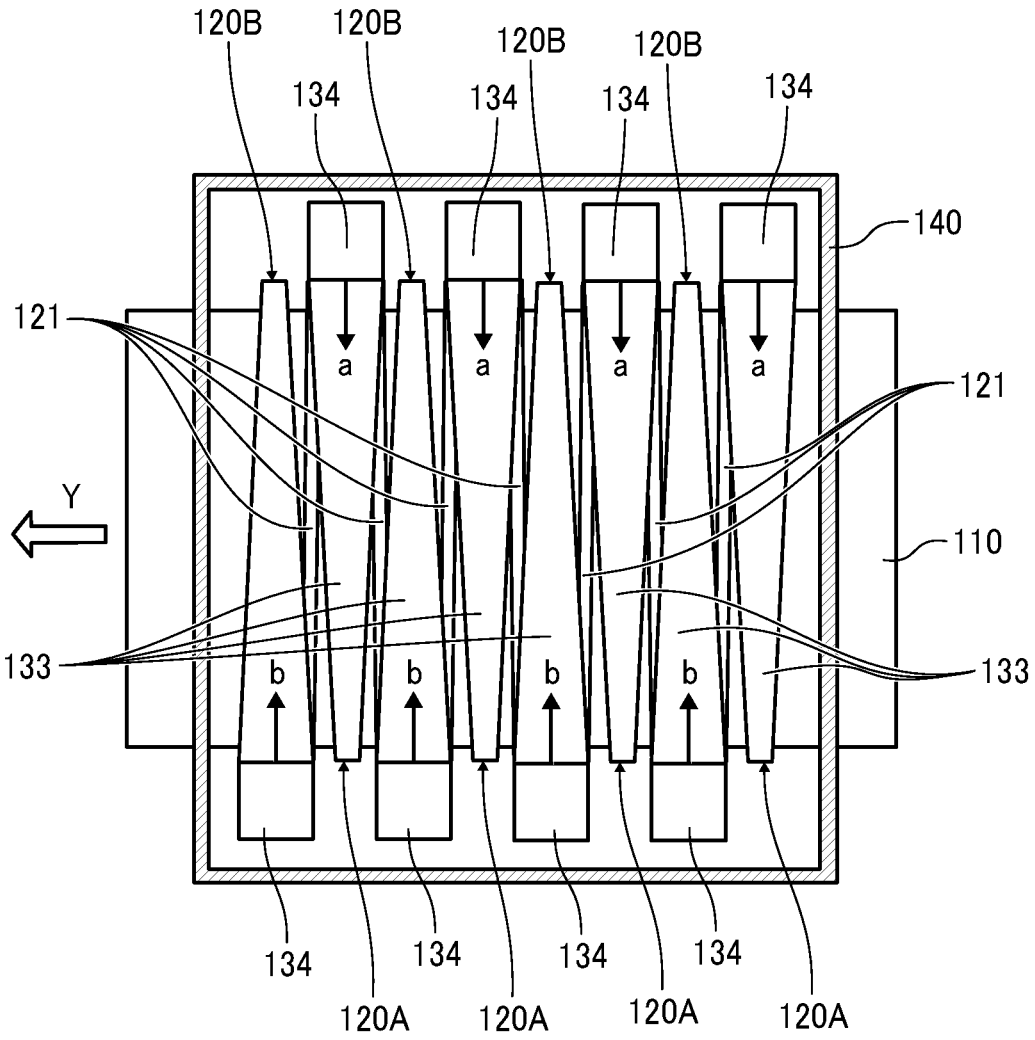
FIG. 8 is a plan view of a drying device according to a third embodiment of the present disclosure.
Figure 9:
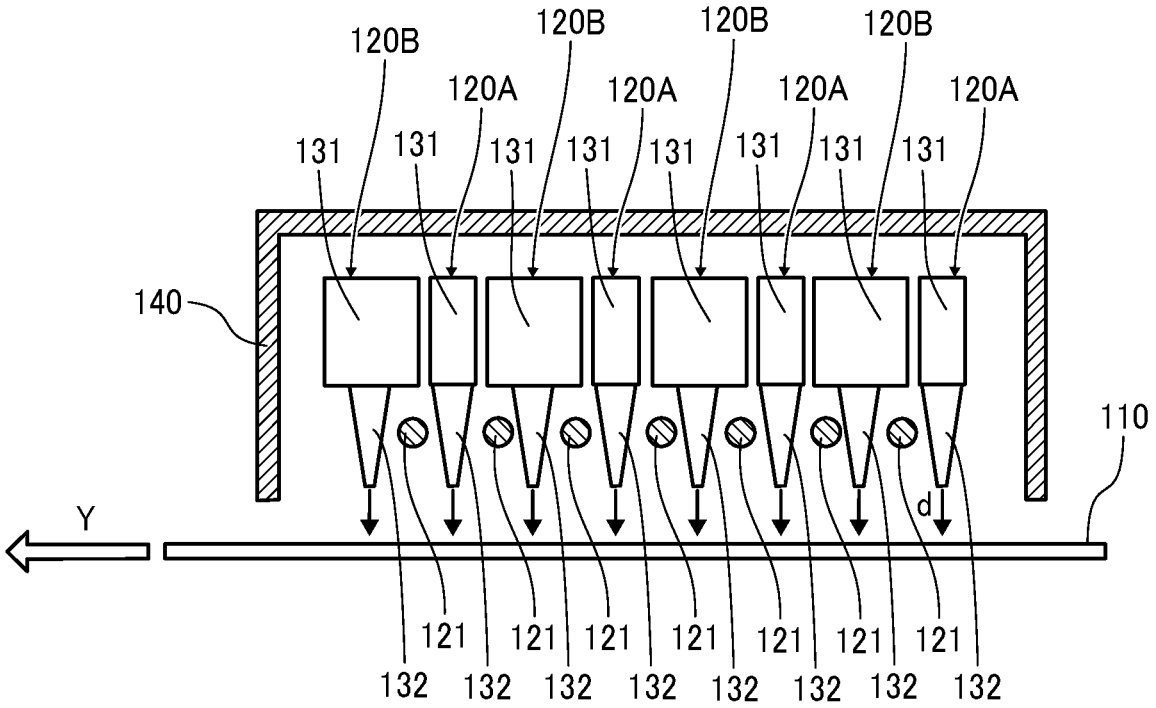
FIG. 9 is a side view of the drying device according to the third embodiment.
Figure 10:
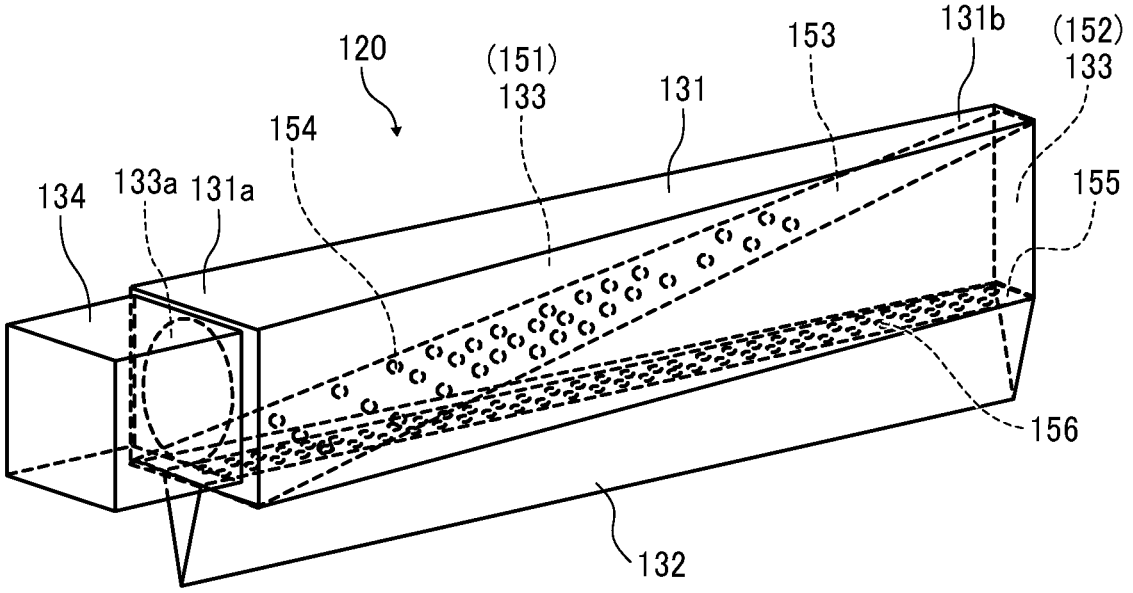
FIG. 10 is a perspective view of the gas blower in the drying device according to the third embodiment.

Next, a third embodiment of the present disclosure is described with reference to FIGS. 8 to 10. FIG. 8 is a schematic plan view of the drying device 104 according to the third embodiment. FIG. 9 is a side view of the drying device 104 according to the third embodiment. FIG. 10 is a perspective view of a gas blower of the third embodiment. The gas blower serves as an air blower of the drying device 104.

In the present embodiment, the chamber 131 of the air knife 120 as the gas blower has a wide portion 131*a* and a narrow portion 131*b*. The wide portion 131*a* is one end of the chamber 131 in the longitudinal direction of the chamber 131. A width of the wide portion 131*a* is relatively wide in the conveyance direction Y of the continuous sheet 110. The narrow portion 131*b* is another end of the chamber 131 in the longitudinal direction of the chamber 131. A width of the narrow portion 131*b* is relatively narrow in the conveyance direction Y of the continuous sheet 110. The width of the wide portion 131*a* is wider than the width of the narrow portion 131*b* in the conveyance direction Y.

A fan 134 as an airflow generator is disposed on the wide portion 131*a* of the chamber 131. Therefore, the interior 133 of the chamber 131 of each of the air knives 120A and 120B has a tapered shape in which the width of the interior 133 of the chamber gradually decreases from one end (wide portion 131*a*) at which the fan 134 is disposed to another end (narrow portion 131*b*) of the chamber 131 in the longitudinal direction of the chamber 131 perpendicular to the conveyance direction Y of the continuous sheet 110.

The chamber 131 includes a partition member 153 to partition the interior 133 into a first space 151 and a second space 152 and an air flow guide 155 disposed between the second space 152 and the nozzle 132.

The partition member 153 according to the third embodiment in FIG. 10 includes openings 154. As illustrated in FIGS. 4 and 6 in the first embodiment, the openings 154 are formed in the partition member 153 such that an opening ratio of the openings 154 in the central portion is larger than an opening ratio of the openings 154 in both end portions in the longitudinal direction of the chamber 131. The openings 156 of the air flow guide 155 are arranged so that an opening ratio of the openings 156 is substantially uniform in the longitudinal direction of the chamber 131.

Two air knives 120A and 120B adjacent to each other in the conveyance direction Y are arranged such that the wide portion 131*a* and the narrow portion 131*b* are alternately arranged. Here, four air knives 120A as the first air blowers and four air knives 120B as the second air blowers are alternately arranged.

Thus, the chambers 131 of two adjacent air knives 120A and 120B in the conveyance direction Y overlap with each other in the direction intersecting (perpendicular to) the conveyance direction Y.

With an overlapping configuration of the air knives 120A and 120B, the drying device 104 can arrange a plurality of air knives 120A and 120B with high density in the conveyance direction Y while reducing drying unevenness on the continuous sheet 110. Thus, the third embodiment can reduce a size of the drying device 104. Further, densely arranged air knives 120A and 120B of the third embodiment can improve a drying capacity of the drying device 104.

Figure 11:
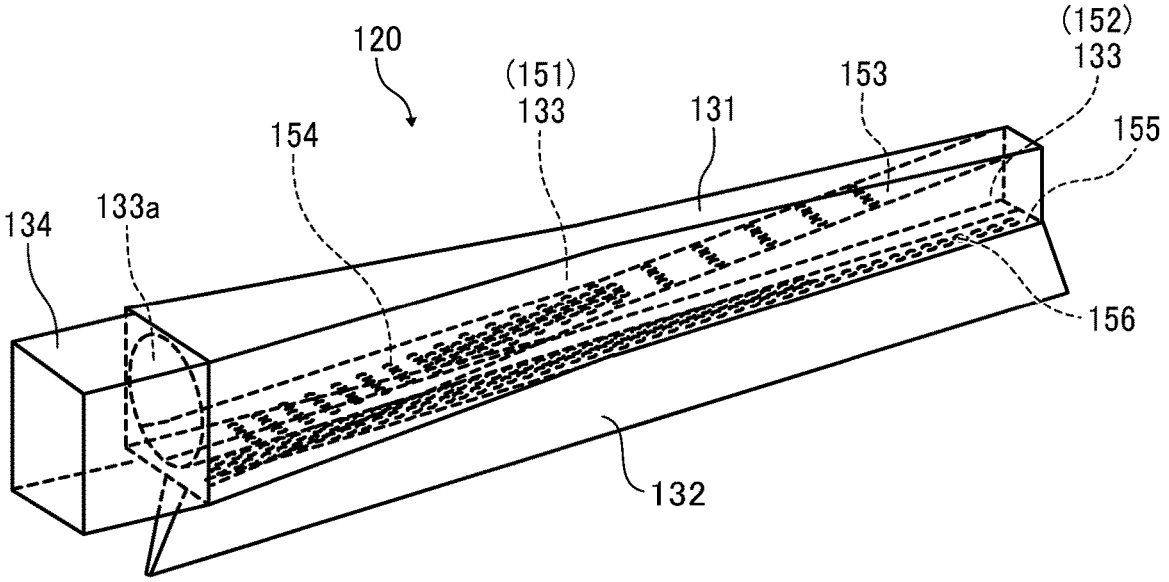
FIG. 11 is a perspective view of the gas blower according to a fourth embodiment.

Next, a fourth embodiment of the present disclosure is described below with reference to FIG. 11. FIG. 11 is a perspective view of the gas blower of the fourth embodiment.

As in the first embodiment, the partition member 153 according to the fourth embodiment in FIG. 11 includes openings 154 such that an opening ratio of the openings 154 in the central portion is larger than an opening ration of the openings 154 in both end portions in the longitudinal direction of the chamber 131. An opening ratio of one end portion close to the supply port 133*a* is larger than an opening ratio of another end portion on a far side from the supply port 133*a* in the opening ratio at the both end portions in the longitudinal direction of the partition member 153.

In the fourth embodiment, the width of the chamber 131 in a transverse direction of the chamber 131 (width of the chamber 131 in the conveyance direction Y) gradually decreases from the supply port 133*a* side to the central portion in the longitudinal direction of the chamber 131. The chamber 131 has an outer shape of approximately the same width from the central portion to another end portion opposite the supply port 133*a*.

As described above, the opening ratio at the both end portions in the longitudinal direction of the partition member 153 is configured such that the opening ratio of the end portion on one side close to the supply port 133*a* is made larger than the opening ratio of another end portion on the far side from the supply port 133*a*. Thus, the fourth embodiment can even out the temperature of the air in the longitudinal direction of the chamber 131 as compared with the third embodiment.

The temperature on one side (supply port 133*a* side) close to the fan 134 is low. Thus, a difference of temperature in a vicinity of the nozzle 132 occurs between the central portion (region A) and one end portion (region B) of the supply port 133*a* side close to the fan 134 when the opening ratio of one end portion (the supply port 133*a* side) is higher than the opening ratio of the central portion.

The temperature of the region C is higher than the temperature of the regions A and B even at the end portions in the longitudinal direction of the chamber 131 when the opening ratio of one end portion (region B in FIG. 6) of the supply port 133*a* side close to the fan 134 and the opening ratio of another end portion (region C in FIG. 6) is made identical.

The above-described phenomenon occurs because the air is blown from one end portion of the supply port 133*a* close to the fan 134 in the longitudinal direction of the chamber 131. Thus, the air generated by the fan 134 passing through the openings 154 of the partition member 153 and reaching the vicinity of the air flow guide 155 slightly moves to the far side from the fan 134 (region C side in FIG. 6).

Therefore, the opening ratio of the fan 134 side (region B in FIG. 6) is preferably larger than the opening ratio of the region opposite the fan 134 (region C in FIG. 6).

Further, also in the central portion (region A in FIG. 6) in the longitudinal direction of the chamber 131, the opening ratio of the region closer to the supply port 133*a* (region B in FIG. 6) is made larger than the opening ratio of the region far from the supply port 133*a* (region C in FIG. 6). In the above-described case, the opening ratio of the central portion (region A in FIG. 6) is made larger than the opening ratio of both end portions (regions B and C in FIG. 6). Thus, the opening ratio of the central portion (region A in FIG. 6) closer to the supply port 133*a* side becomes the maximum opening ratio in the longitudinal direction of the chamber 131.

Table 1 illustrates temperature and speed of the air blown (discharged) from the nozzle 132 according to a distance from the central portion (region A in FIG. 6). The distance from the central portion is illustrated such that a position in the supply port 133*a* side (region B side in FIG. 6) is indicated by plus and the position opposite the supply port 133*a* side (region C side in FIG. 6) is indicated by minus in the fourth embodiment.

TABLE 1

| POSITION [m] | TEMPERATURE [° C.] | SPEED [m/s] |
|---|---|---|
| 0.26 | 83.3 | 21.9 |
| 0.21 | 82.8 | 22.5 |
| 0.17 | 81.1 | 22.2 |
| 0.12 | 79.9 | 23.0 |
| 0.08 | 78.5 | 23.2 |
| 0.03 | 78.1 | 23.4 |
| −0.01 | 78.9 | 23.2 |

TABLE 1-continued

| POSITION [m] | TEMPERATURE [° C.] | SPEED [m/s] |
|---|---|---|
| −0.06 | 77.3 | 23.0 |
| −0.1 | 79.7 | 22.6 |
| −0.15 | 78.6 | 22.4 |
| −0.19 | 81.0 | 21.6 |
| −0.23 | 85.3 | 21.3 |
| −0.26 | 78.8 | 21.2 |

As it can be seen from Table 1, the present embodiment can reduce the difference in temperature in the longitudinal direction of the chamber 131 within a range of approximately 6° C. and reduce the difference in speed within a range of 2 (m/s).

Thus, the present embodiment makes the opening ratio of the region close to the fan 134 (region B in FIG. 6) to be larger than the opening ratio of the region opposite the fan 134 (region C in FIG. 6), and thus can even out any difference in the temperature, in which the temperature in the other end portion opposite the fan 134 (region C in FIG. 6) becomes higher than the temperature in the central portion (region A in FIG. 6) and in the one end portion close to the fan 134 (region B in FIG. 6). Thus, the fourth embodiment can even out the temperature of air discharged from the nozzle 132.

Figure 12:
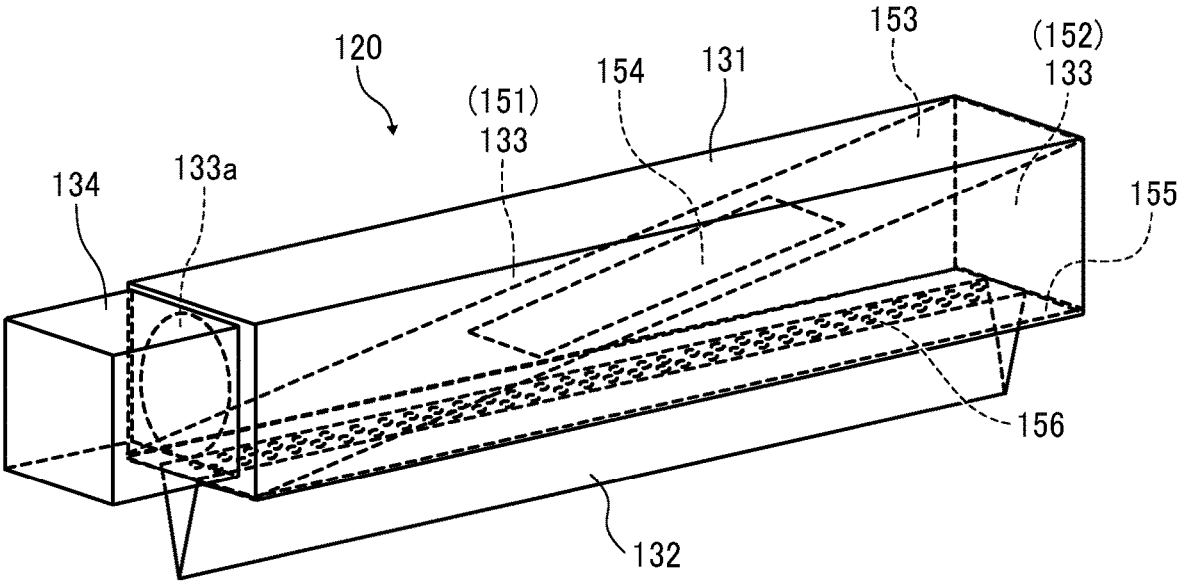
FIG. 12 is a perspective view of the gas blower according to a fifth embodiment.

Next, a fifth embodiment of the present disclosure is described with reference to FIG. 12. FIG. 12 is a perspective view of the gas blower of the fifth embodiment.

In the fourth embodiment, the partition member 153 includes one opening 154 at the central portion in the longitudinal direction of the partition member 153 and does not include openings 154 at both end portions in the longitudinal direction of the partition member 153 in the configuration of the first embodiment (see FIGS. 2 to 6). That is, the partition member 153 has a region where the opening 154 is provided and a region where the opening 154 is not provided. The opening 154 of the fourth embodiment has an area larger than the area of the openings 154 in each of the above-described embodiments.

Such a configuration in which the partition member 153 does not include a plurality of openings 154 and includes one opening 154 in the central portion of the partition member 153 can achieve operation effects equivalent to the operation effects of each of the above-described embodiments.

Figure 13:
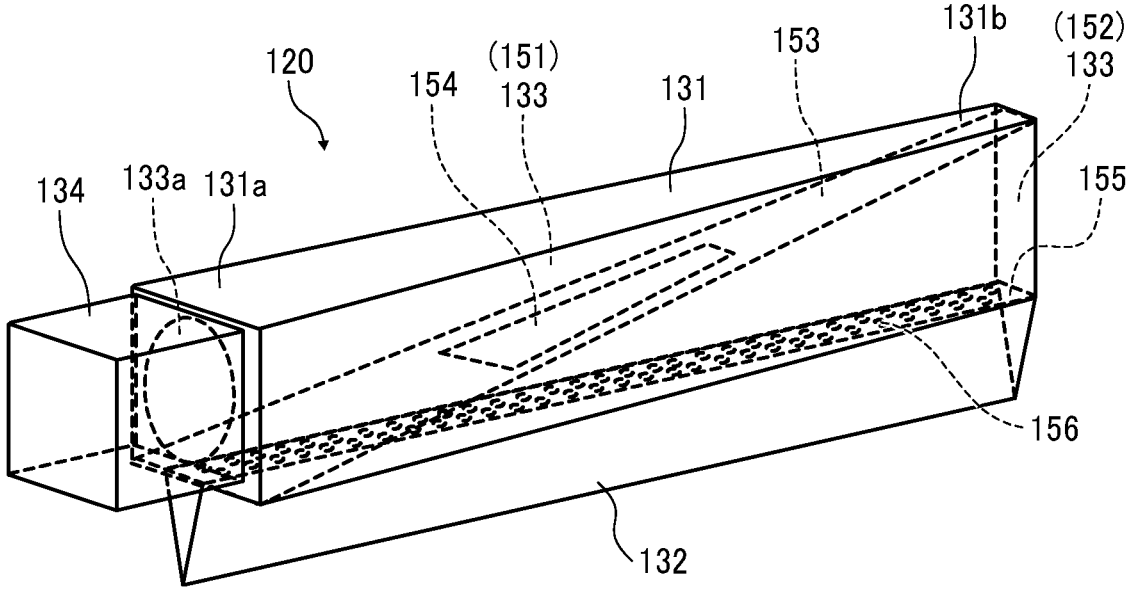
FIG. 13 is a perspective view of the gas blower according to a sixth embodiment.

A sixth embodiment according to the present disclosure is described with reference to FIG. 13. FIG. 13 is a perspective view of the gas blower of the sixth embodiment.

The sixth embodiment is a combination of the third embodiment (see FIGS. 8 to 10) and the fifth embodiment (see FIG. 12) in which the partition member 153 includes one opening 154 at the central portion in the longitudinal direction of the partition member 153 and does not include openings 154 at both end portions in the longitudinal direction of the partition member 153. The opening 154 of the sixth embodiment has an area larger than an area of the openings 154 in each of the above-described embodiments. Further, the interior 133 of the chamber 131 has a tapered shape in which the width of the interior 133 of the chamber 131 gradually decreases from one end (wide portion 131*a*) at which the fan 134 is disposed to another end (narrow portion 131*b*) of the chamber 131 in the longitudinal direction of the chamber 131.

Figure 14:
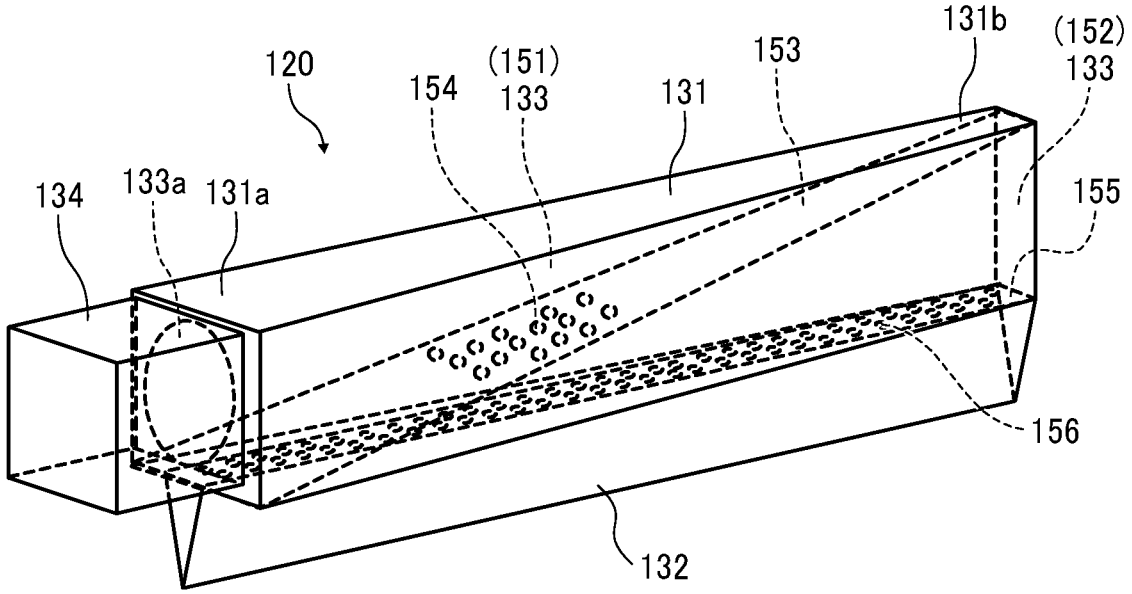
FIG. 14 is a perspective view of the gas blower according to a seventh embodiment.

A seventh embodiment according to the present disclosure is described with reference to FIG. 14. FIG. 14 is a perspective view of the gas blower of the seventh embodiment.

In the seventh embodiment, the partition member 153 includes a plurality of openings 154 in the central portion in the longitudinal direction of the partition member 153 and does not include opening in both end portions of the partition member 153 in the longitudinal direction of the partition member 153. Also in the seventh embodiments, the partition member 153 includes a region including openings 154 and a region not including the openings 154. Further, as in the sixth embodiment (see FIG. 13), the interior 133 of the chamber 131 has a tapered shape in which the width of the interior 133 of the chamber 131 gradually decreases from one end (wide portion 131*a*) at which the fan 134 is disposed to another end (narrow portion 131*b*) of the chamber 131 in the longitudinal direction of the chamber 131.

Such a configuration in which the partition member 153 includes a plurality of openings 154 in the central portion of the partition member 153 and does not include openings 154 in both end portions of the partition member 153 can achieve operation effects equivalent to the operation effects of each of the above-described embodiments.

Figure 15:
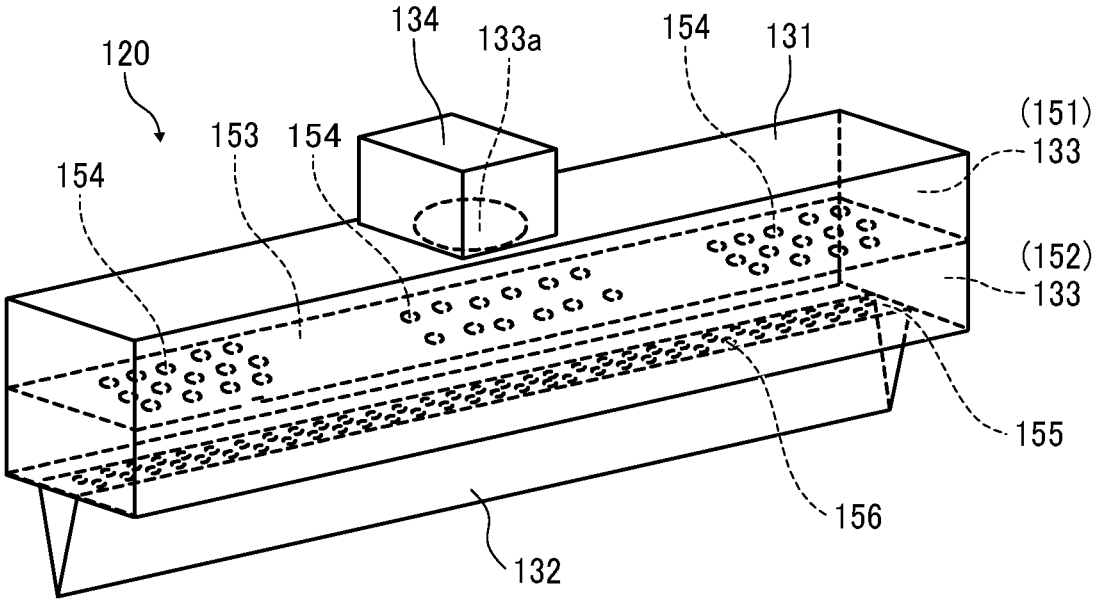
FIG. 15 is a perspective view of the gas blower according to an eighth embodiment.

An eighth embodiment of the present disclosure is described with reference to FIG. 15. FIG. 15 is a perspective view of the gas blower of the eighth embodiment.

In the eighth embodiment, a supply port 133*a* into which the gas is fed from the fan 134 is disposed in a central portion in the longitudinal direction of the chamber 131. Thus, the eighth embodiment has a configuration of supplying the gas from the central portion in the longitudinal direction of the chamber 131.

The chamber 131 includes a partition member 153 to partition the interior 133 into a first space 151 including a supply port 133*a* and a second space 152 not including the supply port 133*a* in the chamber 131.

The partition member 153 includes a plurality of openings 154, and an opening ratio of each of both end portions in the longitudinal direction of the chamber 131 is made larger than an opening ratio at the central portion in the longitudinal direction of the chamber 131.

Further, similarly to the above-described embodiments, the air knife 120 includes the air flow guide 155 between the second space 152 and the nozzle 132.

Thus, when the gas is fed from the supply port 133*a* at the central portion in the longitudinal direction of the chamber 131 to the first space 151 of the interior 133, a flow rate of the gas flowing into the second space 152 from both end portions in the longitudinal direction of the partition member 153 becomes larger than a flow rate of the gas flowing into the second space 152 from the central portion in the longitudinal direction of the partition member 153.

Thus, the air knife 120 of the eighth embodiment can reduce unevenness (variation) in the temperature of the gas blown out (discharged) from the nozzle 132 in the longitudinal direction of the air knife 120.

Figure 16:
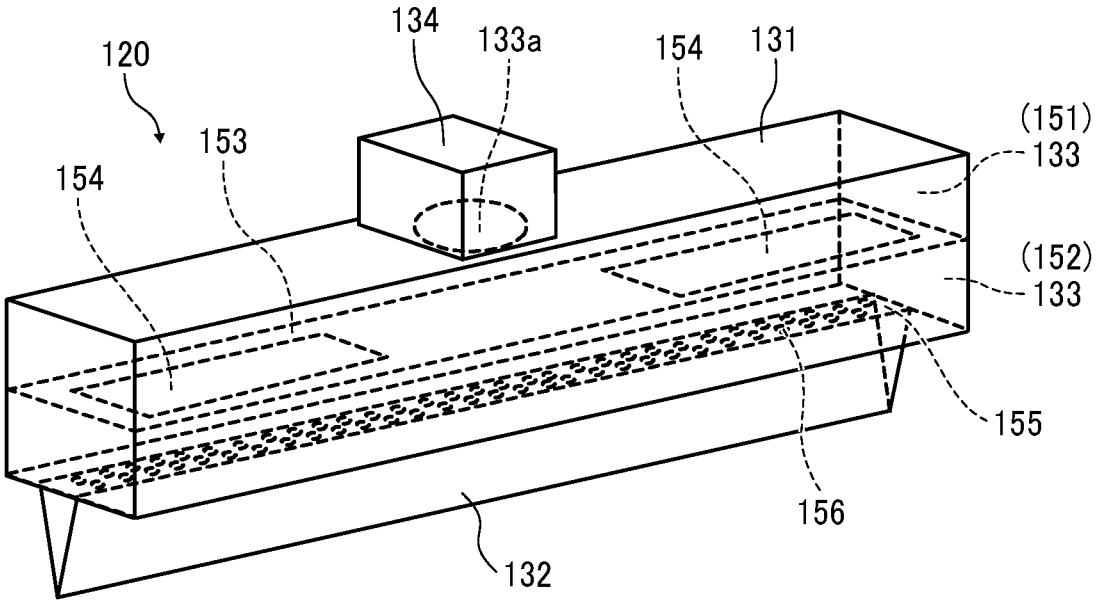
FIG. 16 is a perspective view of the gas blower according to a ninth embodiment.

Next, a ninth embodiment of the present disclosure is described with reference to FIG. 16. FIG. 16 is a perspective view of the gas blower of the ninth embodiment.

In the ninth embodiment, the partition member 153 includes an opening 154 at each end portions in the longitudinal direction of the partition member 153 and does not include the opening 154 in the central portion in the longitudinal direction of the partition member 153.

Even with a configuration as illustrated in FIG. 16, the gas fed from the supply port 133*a* at the central portion in the longitudinal direction of the chamber 131 does not go straight to the nozzle 132. Thus, the ninth embodiment can prevent the flow rate of the gas in the central portion of the chamber 131 from being increased locally. Thus, the air knife 120 of the ninth embodiment can reduce unevenness (variation) in the flow rate of the gas blown out from the nozzle 132 in the longitudinal direction of the air knife 120.

Figure 17:
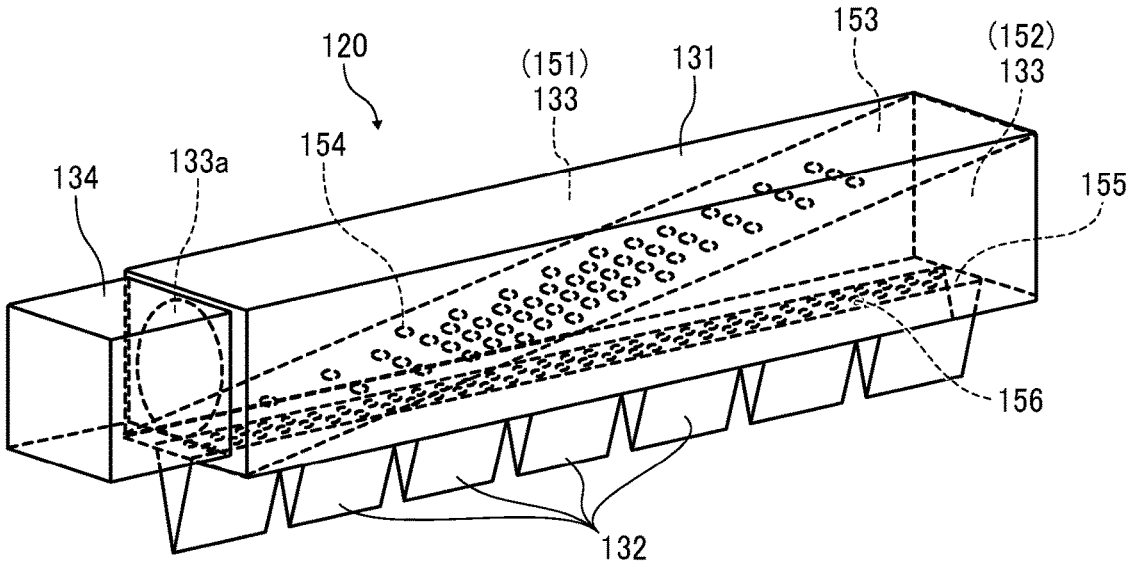
FIG. 17 is a perspective view of the gas blower according to a tenth embodiment.

Next, tenth embodiment of the present disclosure is described with reference to FIG. 17. FIG. 17 is a perspective view of the gas blower according to the tenth embodiment.

In the tenth embodiment, the configuration in the first embodiment is changed such that a plurality of nozzles 132 instead of slit-shaped nozzles 132 (see FIG. 4) is arranged in a row along the longitudinal direction of the chamber 131. The plurality of nozzles 132 serves as a plurality of discharge (blown out) ports in FIG. 17.

According to such a configuration, it is possible to obtain the same functional effect as the functional effect of the first embodiment. Note that the tenth embodiment can also be applied to the second to ninth embodiments.

Each of the above embodiments describes an example in which the chamber 131 includes the fan 134 serving as the airflow generator to feed the airflow from the supply port 133*a* to the interior 133 of the chamber 131. However, the air knife 120 may include an airflow generator separated from the air knife 120, and the air flow generator may be connected to the air knife 120 with a duct to send the gas from the airflow generator to the chamber 131, for example.

Figure 18:
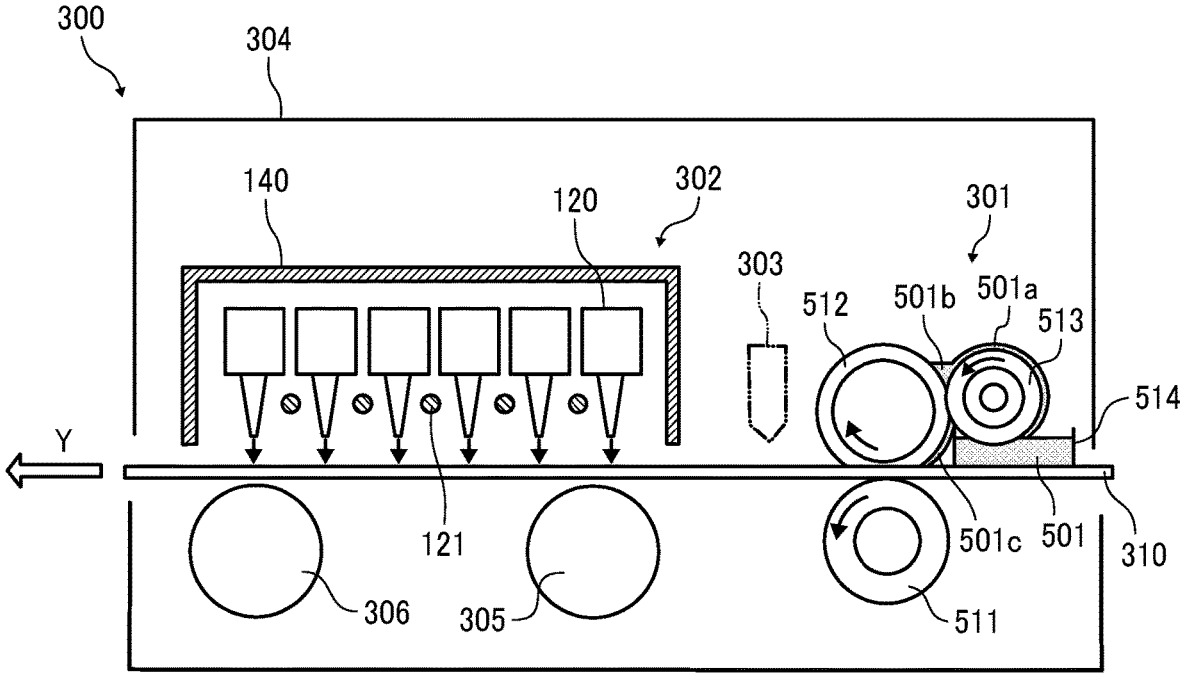
FIG. 18 is a side view of a treatment-liquid application device according to an eleventh embodiment.

Next, an eleventh embodiment of the present disclosure is described with reference to FIG. 18. FIG. 18 is a side view of the treatment-liquid application device according to the eleventh embodiment.

The treatment-liquid application device 300 includes an application device 301 to apply a treatment liquid onto an object to be dried 310 and a drying device 302 according to the present embodiment to dry the object to be dried 310 coated with the treatment liquid in a device exterior 304. Further, the treatment-liquid application device 300 includes conveyance rollers 305 and 306 to convey the object to be dried 310. The treatment-liquid application device 300 serves as a liquid applicator.

Here, the treatment liquid includes, for example, a modification material that modifies the surface of the object to be dried 310 by applying the modification material onto a surface of the object to be dried 310. One example of the modifying material is a fixing agent (setting agent). The fixing agent is preliminarily applied uniformly on the object to be dried 310 to promptly permeate the moisture of the ink into the object to be dried 310, thicken the color component, and also speed up the drying. Thus, the fixing agent can prevent bleeding (or feathering) or strike-through and increase productivity (the number of images output per unit time).

Compositionally, as the treatment liquid, for example, a solution can be used in which cellulose (for example, hydroxypropyl cellulose) that promotes permeation of moisture and a base material, such as talc fine powder, are added to surfactant (for example, any one of anionic, cationic, and nonionic surfactants, or a mixture of two or more of the foregoing surfactants). The treatment liquid 501 may also contain fine particles.

The application device 301 includes a conveyance roller 511 to convey the object to be dried 310, an application roller 512 facing the conveyance roller 511 to apply a treatment liquid 501 to the object to be dried 310, and a squeeze roller 513 to supply the treatment liquid 501 to the application roller 512 to thin a liquid film (a film of the treatment liquid 501). The directions of rotation of the conveyance roller 511, the application roller 512, and the squeeze roller 513 are indicated by arrows D1, D2, and D3, respectively, in FIG. 18. The application roller 512 is disposed in contact with the conveyance roller 511, and the squeeze roller 513 is disposed in contact with the application roller 512.

When the treatment liquid 501 is applied to the object to be dried 310 by the application device 301, the squeeze roller 513 rotates in a direction indicated by arrow in FIG. 18 to make the treatment liquid 501 in the liquid tray 514 to be scooped up by a surface of the squeeze roller 513. The treatment liquid 501 is transferred in a state of the liquid film layer 501*a* by the rotation of the squeeze roller 513 and is accumulated on a valley portion (contact portion: nipping portion) between the squeeze roller 513 and the application roller 512 (treatment liquid 501*b*).

Here, the squeeze roller 513 and the application roller 512 are in contact with each other at a constant pressing force. When the treatment liquid 501*b* accumulated in the valley portion passes between the squeeze roller 513 and the application roller 512, the treatment liquid 501*b* is squeezed by pressure. A liquid film layer 501*c* of the treatment liquid 501 is formed and is conveyed toward the conveyance roller 511 by the rotation of the application roller 512. The liquid film layer 501*c* transferred by the application roller 512 is applied to the object to be dried 310.

The object to be dried 310 applied with the liquid film layer 501*c* of the treatment liquid 501 in such a manner is conveyed to the drying device 302 having substantially the same configuration as the drying device 302 of the above-described embodiment so that a drying process is performed on the object to be dried 310. The object to be dried 310 that has undergone the drying treatment by the drying device 302 is sent to the next step (for example, the liquid application unit 101 in the first embodiment).

Further, as the treatment liquid 501, a liquid which is curable by irradiation with an active energy ray such as ultraviolet ray or the like can be used. In this case, an exposure light source 303 (indicated by virtual line in FIG. 18) or the like as exposure device is disposed between the application device 301 and the drying device 302.

Thus, the treatment liquid 501 may be irradiated with active energy rays from the exposure light source 303 to be partially cured (semi-cured) and dried in the drying device 302 after the treatment liquid 501 is applied onto the object to be dried 310. A configuration of the eleventh embodiment is particularly effective when the treatment liquid 501 contains a photo-polymerization initiator and has a relatively high content of moisture.

The photo-polymerization initiator contained in the treatment liquid 501 is preferably a photo-radical polymerization initiator. Examples of the photo-polymerization initiator include, but are not limited to, aromatic ketones, phosphine oxide compounds, aromatic onium salt compounds, organic peroxides, thio compounds, hexaaryl biimidazole compounds, ketoxime ester compounds, borate compounds, azinium compounds, metallocene compounds, active ester compounds, carbon-halogen-bond-containing compounds, and alkylamine compounds.

Examples of the active energy ray emitted by the exposure light source 303 include, but are not limited to, ultraviolet ray, visible light, α-ray, γ-ray, X-ray, and electron ray. Examples of the exposure light source 303 to emit the active energy ray include, but are not limited to, a mercury lamp, a metal halide lamp, a light emitting diode, and a laser diode.

The application device 301 may using a liquid discharge head to apply the treatment liquid 501.

In each of the above-described embodiments, the air knife 120 as the air blower is arranged in the direction perpendicular to the conveyance direction Y. However, the air knife 120 as the air blower may be disposed at a direction intersecting the conveyance direction Y other than the direction perpendicular to the conveyance direction Y.

In each of the above-described embodiments, the continuous sheet 110 is described as an example of the object to be dried 310 (the object to be dried or the member to be conveyed). However, the object to be dried 310 in the present embodiment is not particularly limited to the continuous sheet 110 and may be anything that can be dried by a drying device 302 according to the present embodiment. For example, the object to be dried 310 may be a continuous body such as continuous sheet, roll paper, web, cut sheet material, wall paper, sheet for electronic circuit board such as prepreg, or the like.

As an object to be dried 310, in addition to recording images such as letters and graphics with a liquid such as ink, an image having no particular meaning such as a pattern or the like is given with a liquid such as ink for the purpose of decoration, decoration, for example.

Herein, the liquid to be applied is not particularly limited, but it is preferable that the liquid has a viscosity of less than or equal to 30 mPa·s under a normal temperature and a normal pressure or by being heated or cooled. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source to discharge a liquid include an energy generation source using a piezoelectric actuator (a lamination piezoelectric element and a thin-film piezoelectric element), a thermal actuator using an electrothermal transducer element such as a heating resistor (element), a static actuator including a diaphragm plate and opposed electrodes, and the like.

The terms "printing" in the present embodiment may be used synonymously with the terms of "image formation", "recording", "printing", and "image printing".

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A gas blower comprising:

a supply port;

a chamber to which a gas is fed from the supply port;

a nozzle communicating with an interior of the chamber to discharge the gas from the nozzle;

a partition member disposed in the chamber to partition the interior of the chamber into a first space including the supply port and a second space not including the supply port, the partition member including at least one first opening through which the gas communicates between the first space and the second space; and an air flow guide including a plurality of second openings, disposed in the chamber between the second space and the nozzle, the supply port being disposed on one end in a longitudinal direction of the chamber, an opening ratio of the first opening of the partition member at a central portion in a longitudinal direction of the partition member being larger than an opening ratio of the first opening of the partition member at both end portions in the longitudinal direction of the partition member.

2. The gas blower according to claim 1, wherein a width of the chamber gradually decreases from the one end at which the supply port is disposed to another end in the longitudinal direction of the chamber, and an opening ratio of the first opening of the partition member at one end portion of the both end portions disposed close to the supply port is larger than an opening ratio of the first opening of the partition member at another end portion of the both end portions disposed opposite the supply port in the longitudinal direction of the partition member.

3. The gas blower according to claim 1, wherein the partition member is inclined upward from the one end to another end in the longitudinal direction of the chamber.

4. The gas blower according to claim 1, wherein an opening ratio of the first opening of the partition member at one end portion of the both end portions disposed close to the supply port is larger than an opening ratio of the first opening of the partition member at another end portion of the both end portions disposed opposite the supply port in the longitudinal direction of the partition member.

5. The gas blower according to claim 1, wherein the partition member comprises a region including the first opening and a region not including the first opening.

6. The gas blower according to claim 1, further comprising an air flow generator to feed the gas from the supply port into the interior of the chamber.

7. The gas blower according to claim 1, wherein an opening ratio of the plurality of second openings of the air flow guide is uniform in a longitudinal direction of the air flow guide.

8. A drying device comprising:

a plurality of gas blowers according to claim 1 to discharge the gas onto an object to be dried, the plurality of gas blowers arranged in a direction of movement of an object to be dried; and at least one heater to heat the gas inside the plurality of gas blowers.

9. The drying device according to claim 8, wherein the object to be dried is a member to which a liquid is applied and is conveyed.

10. A liquid discharge apparatus comprising:

the drying device according to claim 9; and a liquid application unit to apply liquid onto an object to be dried.

11. A treatment-liquid application device comprising:

the drying device according to claim 9; and an application device to apply a treatment liquid onto an object to be dried.

12. A gas blower comprising:

a supply port;

a chamber to which a gas is fed from the supply port;

a nozzle communicating with an interior of the chamber to discharge the gas from the nozzle;

a partition member disposed in the chamber to partition the interior of the chamber into a first space including the supply port and a second space not including the supply port, the partition member including at least one first opening through which the gas communicates between the first space and the second space; and an air flow guide disposed in the chamber between the second space and the nozzle, the air flow guide including a plurality of second openings, the supply port being disposed on a central portion in a longitudinal direction of the chamber, an opening ratio of the first opening of the partition member at a central portion in a longitudinal direction of the partition member being smaller than an opening ratio of the first opening of the partition member at both end portions in the longitudinal direction of the partition member.

* * * * *